United States Patent [19]

Cantavespre

[11] 4,440,600

[45] Apr. 3, 1984

[54] SPRING ADJUSTING DEVICE FOR A SELF-SEALING COKE OVEN DOOR

[75] Inventor: Samuel J. Cantavespre, Birmingham, Ala.

[73] Assignee: Haran W. Bullard, Jr., Birmingham, Ala. ; a part interest

[21] Appl. No.: 429,824

[22] Filed: Sep. 30, 1982

[51] Int. Cl.[3] ..... C10B 25/06; C10B 25/16

[52] U.S. Cl. ..... 202/248; 202/269

[58] Field of Search ..... 202/248, 269; 110/173 R

[56] References Cited

U.S. PATENT DOCUMENTS

| | | | |
|---|---|---|---|
| 2,478,215 | 8/1949 | Van Ackeren | 202/248 |
| 4,016,045 | 4/1977 | Van Ackeren | 202/269 |
| 4,028,193 | 6/1977 | Nagayoshi | 202/248 |
| 4,119,496 | 10/1978 | Campana | 202/248 |
| 4,189,352 | 2/1980 | Stanke | 202/248 |
| 4,295,938 | 10/1981 | Haaf | 202/248 |
| 4,337,122 | 6/1982 | Kurihara | 202/248 |

FOREIGN PATENT DOCUMENTS

| | | | |
|---|---|---|---|
| 31130 | 7/1981 | European Pat. Off. | 202/269 |
| 49547 | 4/1982 | European Pat. Off. | 202/269 |

*Primary Examiner*—Bradley Garris

*Attorney, Agent, or Firm*—Woodford R. Thompson, Jr.

[57] ABSTRACT

A spring adjusting device for a self-sealing coke oven door embodies a plurality of elongated, outwardly projecting housings carried by the outer side of the door. Each housing is provided with an elongated passageway therethrough in alignment with an opening through the door adjacent the outer edge thereof. A plunger is mounted for sliding movement through each opening with one end of the plunger engaging a flexible sealing member carried by the door and urging a sealing edge of the sealing member into engagement with the door jamb upon inward movement of the plunger. A compression spring is mounted within the passageway with one end thereof engaging an adjacent end of the plunger. Guide members at each end of the spring retain the spring in alignment with the plunger and out of engagement with the passageway. An actuator carried by the outer end of the housing compresses the spring and urges the plunger toward the sealing member. A heat resistant sealing member provided between the actuator and the housing forms a labyrinth seal which prevents ingress of foreign material therebetween.

6 Claims, 7 Drawing Figures

SPRING ADJUSTING DEVICE FOR A SELF-SEALING COKE OVEN DOOR

BACKGROUND OF THE INVENTION

This invention relates to a self-sealing coke oven door and more particularly to an improved spring adjusting device for a coke oven door which may be quickly and easily adjusted to apply the required force to a flexible sealing member carried by the door. Such adjustments may be made under extreme adverse conditions of fluctuating ambient and operating temperatures during the coking cycle when tar and pitch-like products and coal dust condense on the outer surface of the door.

As is well known in the art to which my invention relates, the ends of a coke oven are equipped with removable refractory-lined coke oven doors. After a coal charge is fully coked and the oven dampered off from the gas main, suitable equipment on both the pusher and coke sides of the coke oven remove the coke oven doors and hold them during the pushing operation. After pushing, the doors are replaced preparatory to recharging the oven. In recent years, various types of self-sealing cast iron coke oven doors have been employed to prevent the escape of volatile products from the coke oven during the approximately 12 to 24 hour coking cycle. Such conventional type doors usually employ a flexible sealing member which carries a continuous sealing edge in position to engage a sealing surface on the cast iron door jamb when the coke doors are replaced after pushing. As disclosed in U.S. Pat. Nos. 2,442,391 and 2,478,215, exposed elongated threaded members have been employed either alone or in combination with a conventional spring loaded plunger device to urge the sealing edge of the sealing member into engagement with the machined surface on the cast iron coke oven door jamb. Such conventional adjusting devices have been found to work satisfactory on doors at ambient temperatures and prior to the doors being placed in operation on the coke oven battery. Once in operation, however, they fail to operate in the proper manner due to the tar and pitch-like products and coal dust being deposited on the exposed threads of the elongated threaded members. Such deposits on the threads freeze the threaded members in place and prevent the operator from adjusting the force applied to the sealing member should a leak develop at this point between the sealing edge and the cast iron door jamb. Also, such conventional adjusting devices are usually constructed from steel and connected to the side of the cast iron door opposite the side thereof carrying the refractory-lined coke oven door plug. When such devices are exposed to operating temperatures ranging from 600° F. to 700° F., the difference in the coefficients of expansion of the steel and cast iron contribute to the improper operation of the adjusting device and in some cases cause the elongated threaded members to freeze in place.

Once the exposed threaded members of such conventional adjusting devices are frozen in place, they are not repaired or replaced until the door is removed from the coke oven and taken to a door repair facility for complete major or minor repairs. However, in recent years federal and local environmental regulatory agencies have set forth regulations which require that only a specific amount of emissions be allowed to escape from each coke oven door during the coking cycle. To keep most conventional coke batteries operating under such regulations requires the coke oven doors to be constantly changed so that frozen adjusting devices may be repaired or replaced. This adds considerable expense to the operation of the battery and in some cases causes batteries which otherwise are fully operational to be shut down prematurely and dismantled completely.

Other conventional adjusting devices for use on self-sealing coke oven doors with which I am familiar are disclosed in U.S. Pat. Nos. 3,990,950 and 4,216,062.

SUMMARY OF THE INVENTION

In accordance with my present invention, I overcome the above and other difficulties by providing an improved spring adjusting device for a self-sealing coke oven door which may be quickly and easily adjusted to apply force to the sealing member carried by the coke oven door even under extreme adverse conditions of fluctuating ambient and operating temperatures during the coking cycle when tar and pitch-like products and coal dust are deposited on the outer surface of the door.

It is an object of my invention to provide an improved spring adjusting device for a self-sealing coke oven door which eliminates frozen adjusting devices carried by the door whereby the operating life of the door is significantly increased.

Another object of my invention is to provide an improved spring adjusting device which may be easily replaced during the coking cycle thereby eliminating the need to remove the door each time an adjusting device carried by the door malfunctions.

Yet another object of my invention is to provide an improved spring adjusting device which may be quickly and easily adjusted either by hand or with a conventional tool during the coking cycle to decrease or increase the force applied to the sealing member thereby reducing the emissions escaping from the coke oven to a level which is below current federal and local environmental standards.

My improved spring adjusting device for a self-sealing coke oven door embodies a plurality of spaced apart elongated outwardly projecting housings carried by the side of the coke oven door opposite the side thereof carrying the sealing member. Each housing is provided with a passageway therethrough in alignment with an opening through the door adjacent the outer edge thereof. An elongated plunger is mounted for sliding movement through each opening with the innermost end of the plunger being in position to engage the sealing member carried by the door and urge a sealing edge carried by the sealing member into engagement with a sealing surface on the coke oven door jamb upon movement of the plunger toward the door jamb. A compression spring is mounted within the passageway with the innermost end of the spring contacting the outermost end of the plunger. Guide members are mounted within the passageway at each end of the spring for retaining the spring in alignment with the plunger and out of engagement with the side walls of the passageway. An actuator member is carried by the outer end of the housing for compressing the spring and urging the plunger toward the door jamb and into engagement with the sealing member. Sealing means is provided between the actuator member and an adjacent portion of the housing to form a labyrinth seal which prevents ingress of foreign material therebetween.

DESCRIPTION OF THE DRAWINGS

A spring adjusting device embodying features of my invention is illustrated in the accompanying drawings, forming a part of this application, in which.

DETAILED DESCRIPTION

Figure 2:
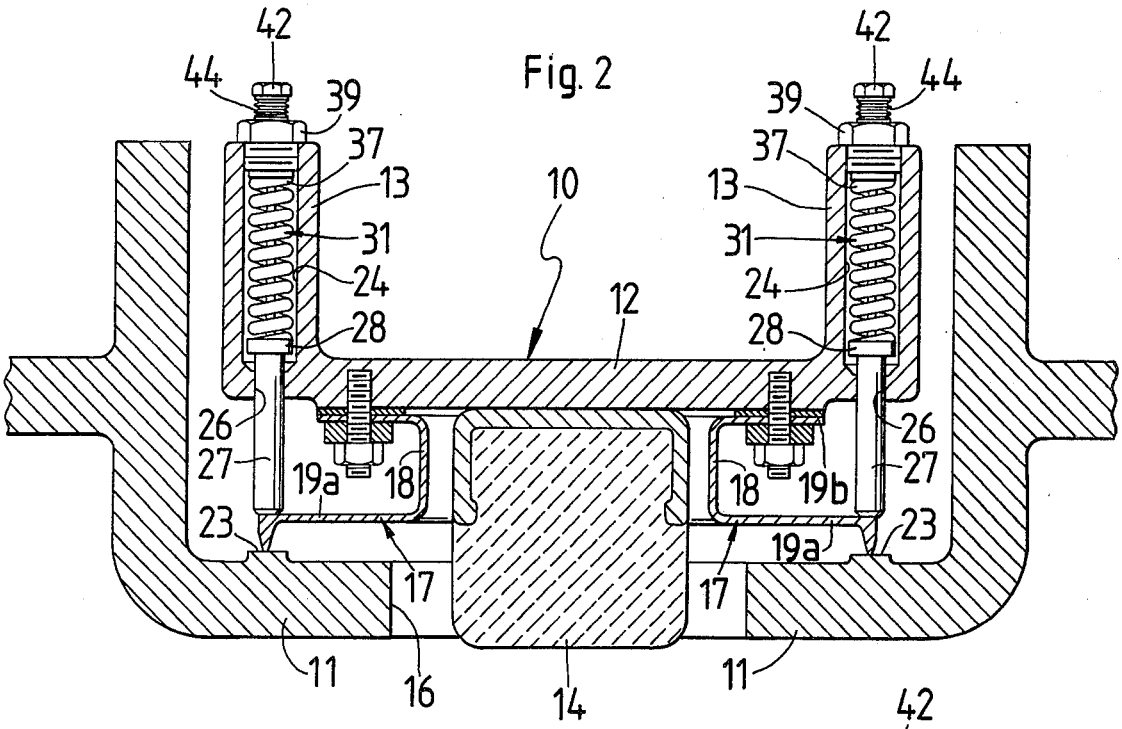
FIG. 2 is an enlarged sectional view taken generally along the line 2—2 of FIG. 1.
Figure 1:
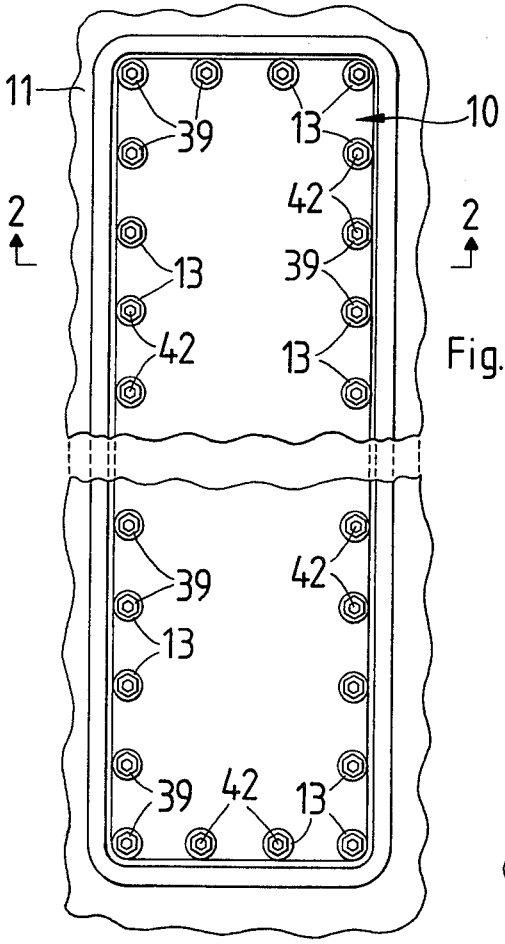
FIG. 1 is an elevational view broken away and showing a coke oven door in engagement with a coke oven door opening at one end of a coke oven.

Referring now to the drawings for a better understanding of my invention, I show in FIGS. 1 and 2 a conventional cast iron coke oven door 10 in engagement with a cast iron coke oven door jamb 11. The door 10 is shown as including a rectangular backing plate 12 and a plurality of spaced apart outwardly extending cylindrical housings 13 which are formed integrally with the door adjacent the outer edge thereof. A refractory-lined door plug 14 is carried by the side of the backing plate 12 opposite the side thereof carrying the housing 13. The door plug 14 engages a coke oven door opening 16 formed by inner portions of the door jamb 11 to transmit radiant heat to the portion of the coal charge facing the coke oven door.

Figure 3:
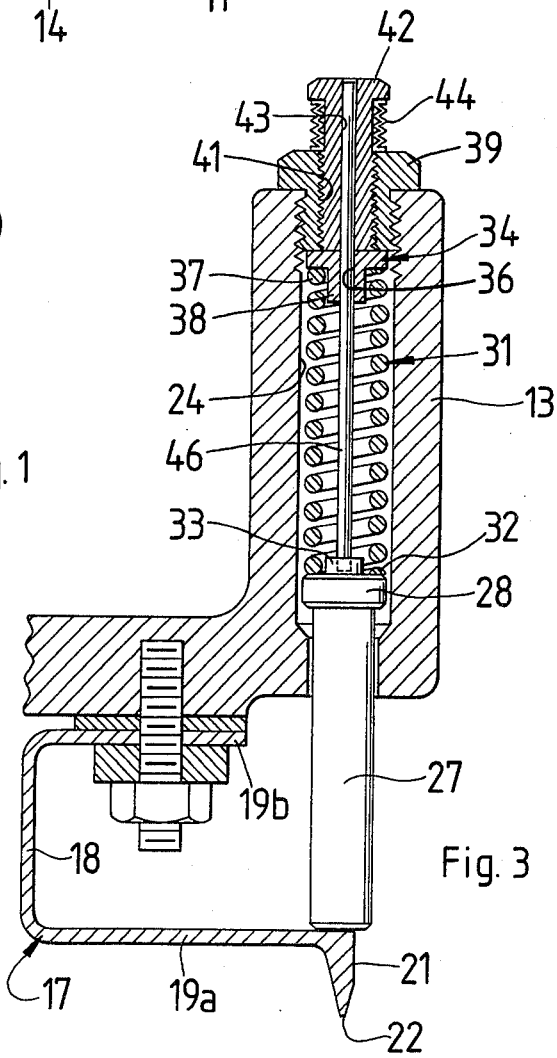
FIG. 3 is an enlarged fragmental sectional view showing my improved spring adjusting mechanism in engagement with the sealing member carried by a coke oven door.

As shown in FIG. 2, a continuous flexible generally U-shaped sealing member 17 is carried by the side of the backing plate 12 facing the door opening 16. The flexible sealing member 17 includes a base 18 and spaced apart legs 19*a* and 19*b*. As shown in FIG. 3, a sealing element 21 extends laterally from the free end of the leg 19*a* and terminates in an approximately ⅛th inch wide sealing edge 22 at its outermost end thereof. When the coke oven door 10 is placed in engagement with the coke oven door 16, the sealing edge 22 engages a continuous machined sealing surface 23 on the door jamb 11, as shown.

As shown in FIGS. 2 and 3, each housing 13 is provided with a cylindrical passageway 24 therethrough in alignment with a plunger receiving opening 26 through the backing plate 12 adjacent the edge thereof. An elongated plunger 27 having an enlarged outer end portion 28 is mounted for sliding movement through each plunger receiving opening 26 with the innermost end of the plunger being adapted to engage the leg 19*a* of the sealing member 17 and urge the sealing edge 22 into engagement with the sealing surface 23 in response to movement of the plunger 27 toward the door opening 16. A compression spring 31 is mounted within the passageway 24 with its innermost end 32 contacting the outer end portion 28 of the plunger 27, as shown. A guide member 33 is carried by the enlarged outer end portion 28 of the plunger 27 in position to engage the innermost end 32 of the spring 31 and limit lateral movement thereof as shown in FIG. 3. A spring cap or guide member 34 having an opening 36 therethrough is mounted at the outermost end 37 of the spring 31, as shown in FIG. 3. The guide member 34 has an inwardly extending portion 38 which engages the outermost end 37 of the spring 31 to limit lateral movement thereof.

As shown in FIG. 3, a closure member 39 having a threaded opening 41 therethrough is threadedly connected to the outer end of the passageway 24. The closure member 39 seals the outer end of the passageway 24 from the contaminated atmosphere of coal dust, tar and pitch-like products surrounding the coke battery. An elongated actuator member 42 having an elongated opening 43 therethrough and fine external threads on the outer surface thereof threadably engages the opening 41, as shown. The actuator member 42 is adapted for rotation in a direction to compress the spring 31 and urge the plunger 27 into engagement with the leg 19*a* of the sealing member 17. As the spring 31 is compressed, the sealing edge 22 carried by the leg 19*a* of the sealing member 17 engages the sealing surface 23 on the door jamb 11 to prevent emissions from escaping from the coke oven. When it is desired to relieve the pressure exerted by the spring 31 on the plunger 27, the actuator member 42 is rotated in a reverse direction whereupon the plunger 27 moves away from the sealing member 17.

As shown in FIGS. 1 and 3, an extendible sealing member 44, which may be in the form of a heat resisting bellows-like member, is interposed between the outer end of the closure member 39 and an adjacent portion of the actuator member 42. The extendible member 44 forms a labyrinth seal between the actuator member and the outer edge of the closure member 39 to thus prevent foreign material from being deposited on the threads of the actuator member 42 and within the threaded opening 41. As the actuator member 42 is rotated in opposite directions, extendible member 44 contracts and expands to maintain the labyrinth seal between the closure member 39 and the outer end of the actuator member 42. While I have shown the extendible member 44 as being a bellows-like member, it will be apparent that other heat resisting resilient members may be employed to maintain the labyrinth seal between the closure member 39 and the actuator member 42.

As shown in FIG. 3, an elongated rod-like member 46 is carried by and extends outwardly from the guide member 33. The rod-like member 46 slidably engages the opening 36 in the guide member 34 and the opening 43 in the actuator member 42 to thus maintain the guide member 34 in axial alignment with the spring 31 and out of engagement with the side walls of the passageway 24. That is, as the actuating member 42 is rotated in a direction to compress the spring 31, the guide member 34 slides longitudinally and inwardly along the rod-like member 46 to engage and compress the spring 31, as shown. This controlled movement of the guide member 34, assured by the labyrinth seal around the actuator member 42, permits the force exerted on the plunger 27 to be quickly and easily adjusted to compensate for any leak that might occur between the sealing edge 22 and the sealing surface 23.

From the foregoing description, the operation of my improved spring adjusting device shown in FIGS. 1–3 will be readily understood. With my improved spring adjusting devices assembled in the housings 13 carried by the coke oven door 10, the door is then placed into engagement with the coke oven door jamb 11, as shown in FIG. 2. Each actuator member 42 is then rotated to compress its spring 31 whereupon the sealing edge 22 carried by sealing member 17 is moved into sealing engagement with the sealing surface 23 on the door jamb 11. If a leak should occur around the edge 22 of the sealing member 17 during the coking cycle, the actuating member 42 may be easily rotated to urge the sealing edge 22 into proper sealing engagement with the sealing surface 23. If a spring adjusting device should malfunction during the coking cycle, the entire device may be easily changed by removing the threaded closure member 39 and then removing the spring 31 and plunger 27. A new spring adjusting device may then be assembled in the housing to urge the sealing edge 22 into sealing engagement with the sealing surface 23 on coke oven door jamb 11.

Figure 4:
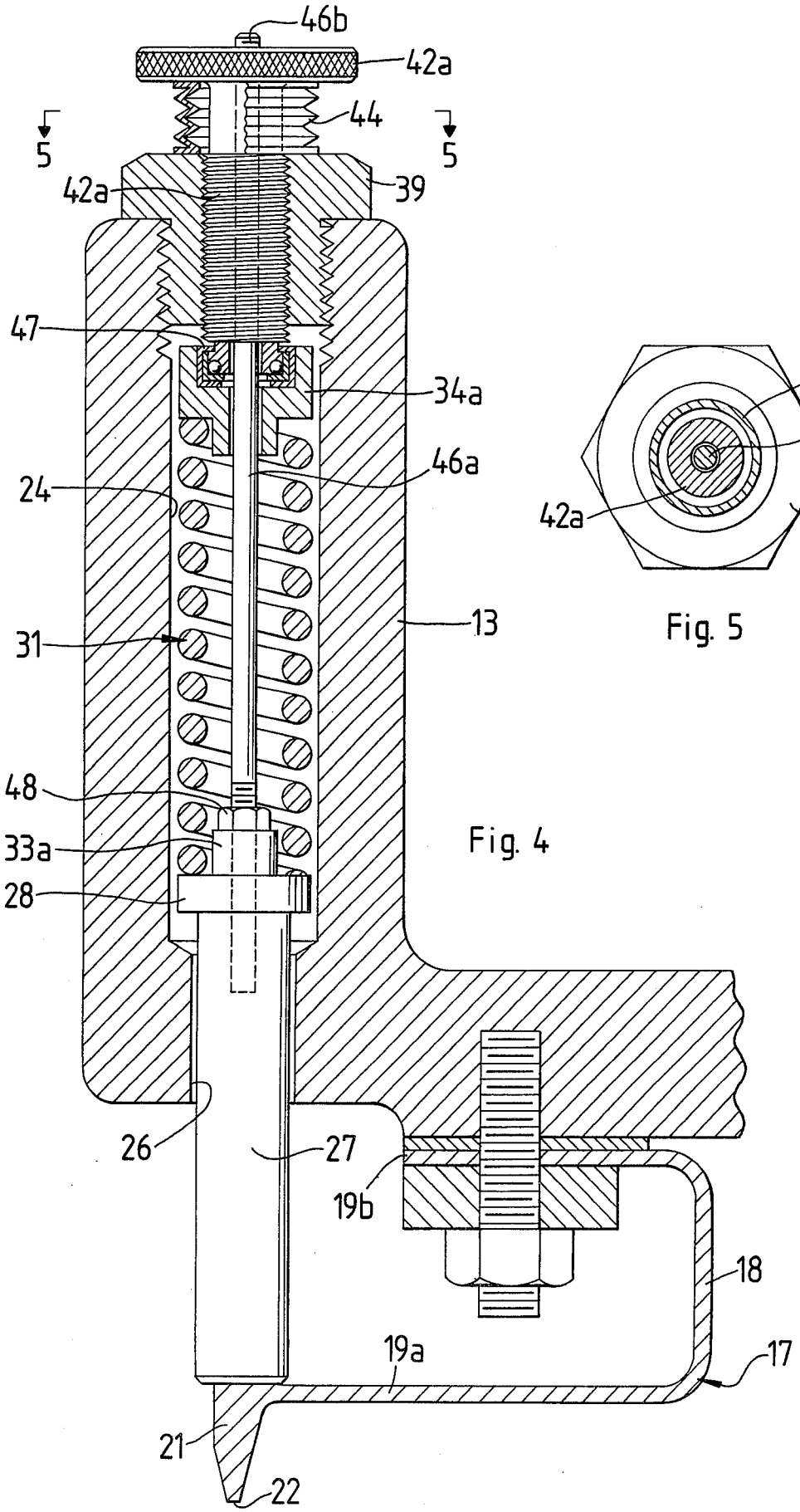
FIG. 4 is an enlarged, fragmental sectional view corresponding to FIG. 3 showing a modified form of my invention.
Figure 5:
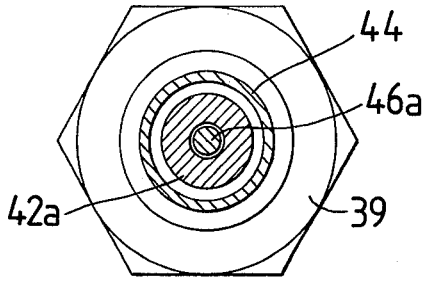
FIG. 5 is a view partly in section taken generally along the line 5—5 of FIG. 4.

Referring now to FIGS. 4 and 5, I show a modified form of my invention which is identical in structure to the spring adjusting mechanism described above relative to the first embodiment except that a thumb screw type elongated actuator member **42*a* is in threaded engagement with the threaded opening 41 in the closure member 39. As the actuator member 42*a* is rotated in a direction to compress the spring 31, its innermost end engages the inner race of a bearing 47 mounted in a guide member 34*a* mounted at the outermost end of the spring 31. The bearing 47 thus reduces friction between the actuator member 42*a* and the guide member 34*a* and permits the operator to easily rotate the actuator member 42*a* by hand to compress the spring 31 and urge the sealing edge 22 into sealing engagement with the sealing surface 23 on the coke oven door jamb 11**.

As shown in FIG. 4, a nut 48 is mounted on the outer end of a guide member **33*a* carried by the outer end of the plunger 27 in threaded engagement with one end of an elongated rod-like member 46*a*. This arrangement permits the length of the rod-like member 46*a* to be varied whereby the force exerted on the plunger 27 may be accurately measured and observed. That is, indicia 46*b* may be provided on the outer end portion of the rod-like member 46*a* to indicate the amount of force being applied to the plunger 27 by the compression of the spring 31. When the actuator member 42*a* is rotated in a direction to compress the spring 31, its outermost surface will move inwardly toward the closure member 39 and align the indicia 46*b* on the outer portion of the rod-like member 46*a* with the outer surface of the member 42*a* to indicate the amount of force being applied to the plunger 27 by the spring 31**.

Figure 6:
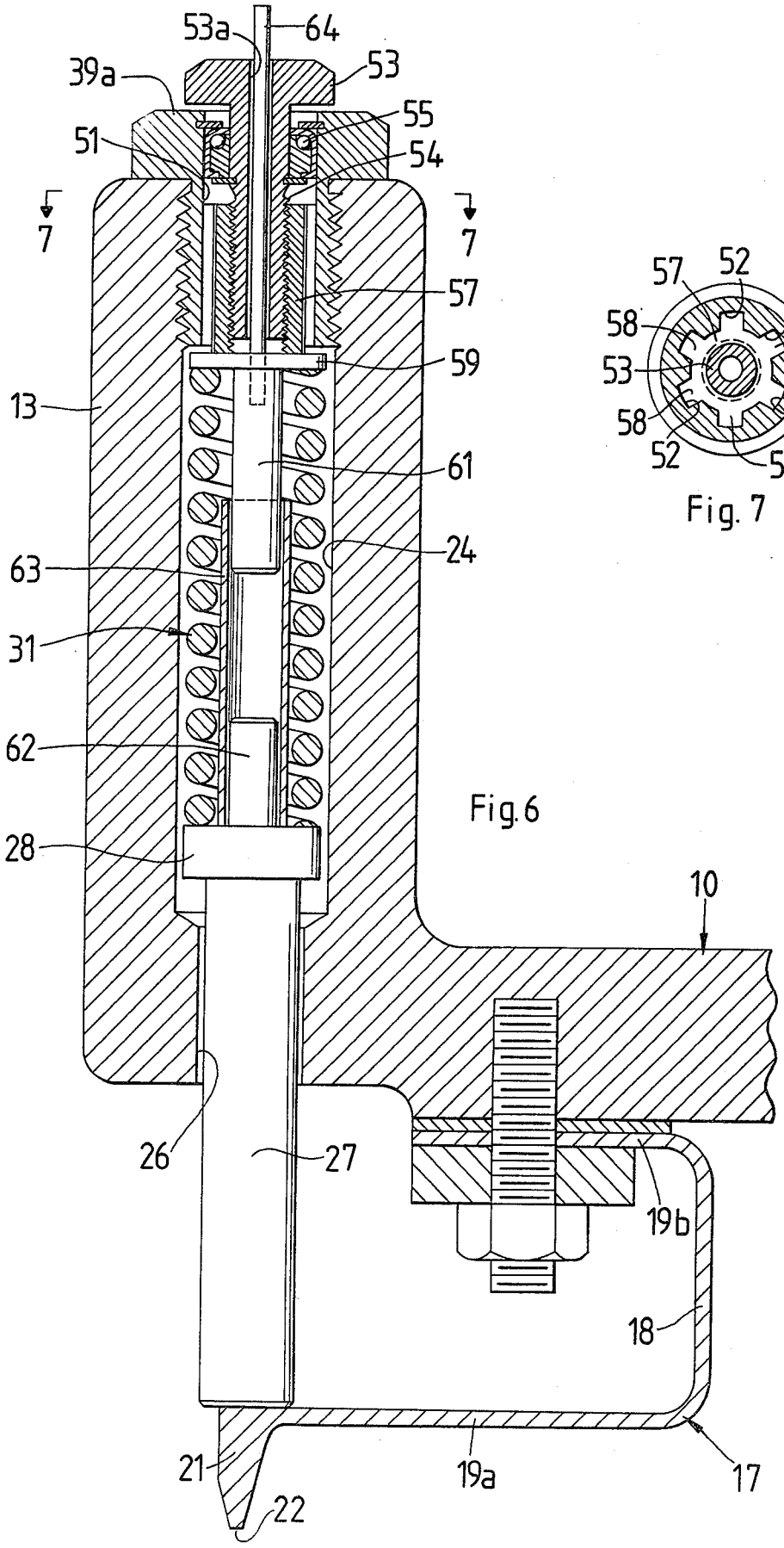
FIG. 6 is a fragmental, sectional view corresponding to FIG. 4 showing another modified form of my invention; and, FIG. 7 is a sectional view taken generally along the line 7—7 of FIG. 6.
Figure 7:
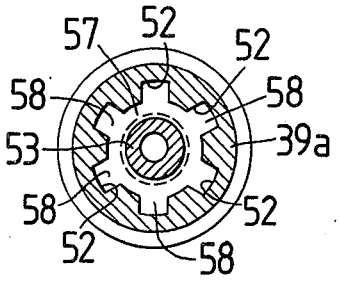

Referring now to FIGS. 6 and 7, I show another modified form of my invention which is similar in structure to that described above with reference to the first embodiment except that it includes a closure member **39*a* having an elongated opening 51 therethrough in alignment with the passageway 24. The closure member 39*a* is threadedly connected to an internally threaded portion on the outer end of the passageway 24, as shown, and includes a plurality of annularly spaced parallel grooves 52 in its lower portion, as shown in FIG. 7. An elongated rotatable member 53 having a longitudinally extending opening 53*a* therethrough and external threads 54 on a lower portion thereof is mounted for rotation in the opening 51 in the closure member 39*a*, as shown. A sealed, heat resistant thrust bearing 55 is interposed between the elongated rotatable member 53 and an outer portion of the opening 51 in the closure member 39*a* to maintain the elongated rotatable member in axial alignment with the spring 31. The thrust bearing 55 also forms a labyrinth seal between the closure member 39*a* and the elongated rotatable member 53 to thus prevent foreign materials from being deposited on the external threads 54 of the elongated rotatable member 53. An internally threaded sleeve-like member 57 having a plurality of annularly spaced parallel splines 58 is mounted within the lower portion of the closure member 39*a* in threaded engagement with the elongated rotatable member 53, as shown. The splines 58 carried by the sleeve-like member 57 engage the spline receiving grooves 52 in the closure member 39*a* to limit rotation of the sleeve-like member 57 as the elongated rotatable member 53 is rotated in a direction to compress the spring 31. That is, as the elongated rotatable member 53 is rotated in the direction to compress the spring 31, the splines 58 engage the spline grooves 52 to limit rotation of the sleeve-like member 57 while at the same time permit the sleeve-like member to move, axially toward a guide member or spring cap 59 mounted at the outermost end of the spring 31. The axial movement of the sleeve-like member 57 into engagement with the guide member 59 compresses the spring 31 and urges the plunger 27 into engagement with the sealing member 17 in the manner described above relative to the first embodiment. As shown in FIG. 6, the guide member 59 includes an elongated inwardly extending portion 61 which engages the outermost end of the spring 31 to limit lateral movement thereof. Mounted on the enlarged outer end portion 28 of the plunger 27 is an elongated guide member 62 which engages the innermost end of the spring 31 to limit lateral movement thereof. An elongated tubular member 63 extends between and is slidably connected to the guide members 59 and 62 as shown. The tubular member 63 maintains the guide members in alignment with each other and limits lateral movement of the spring 31 as the actuator member 53** compresses the spring.

As shown in FIG. 6, a rod-like member 64 is carried by the guide member 59 in position to slidably engage the opening **53*a* through the actuating member 53. The rod-like member 64 limits lateral movement of the guide member 59 which in turn prevents the spring 31 from engaging the side walls of the passageway 24 as the actuator member 53 is rotated in the direction to compress the spring 31**.

From the foregoing, it will thus be seen that I have devised an improved spring adjusting device for sealing coke oven doors when a leak occurs between the sealing edge of the door and its door jamb which permits quick and easy adjustment of the force applied to seal the door. Also, by providing a spring adjusting device having a heat resistant sealing element that forms a labyrinth seal between the actuator member and the closure member, I provide a spring adjusting device which eliminates foreign material from being deposited on the threads of the actuator member which heretofore caused the actuator member to freeze in place after only a few hours of operation. Furthermore, by providing a spring adjusting device having guide members which limit lateral movement of the spring within the passageway, I provide an adjusting mechanism that maintains the spring in alignment with the actuator member and out of engagement with the side walls of the passageway.

While I have shown my invention in several forms, it will be obvious to those skilled in the art that it is not so limited, but is susceptible of various changes and modifications without departing from the spirit thereof.

What I claim is:

1. In a self-sealing coke oven door carrying a flexible sealing member at the side thereof facing an opening for a coke oven door and including a continuous sealing edge in position to engage an adjacent sealing surface on a coke oven door jamb in response to placement of the door within its coke oven door opening, the improvement comprising:

(a) there being a plurality of spaced apart plunger receiving openings extending through and disposed around the coke oven door adjacent the outer edge thereof, (b) there being a plurality of elongated, outwardly projecting housings carried by the side of said door opposite the side thereof carrying said sealing member with each said housing having a passageway therethrough in alignment with an adjacent plunger receiving opening, (c) an elongated plunger mounted for sliding movement through each said plunger receiving opening with the innermost end of said plunger in position to engage said sealing member and urge said sealing edge into engagement with said sealing surface upon movement of said plunger toward said door jamb, (d) a compression spring mounted within said passageway with the innermost end of said spring contacting the outermost end of said plunger, (e) alignment means within said passageway engaging said spring and retaining said spring out of engagement with the side walls of said passageway, (f) an elongated threaded actuator member carried by the outer end of each said housing for compressing said spring and urging said plunger toward said door jamb and into engagement with said sealing member, (g) a closure member enclosing the outer end of said passageway and including a threaded opening therethrough in alignment with said passageway for receiving said threaded actuator member, and (h) an extensible member interposed between said closure member and said actuator member and defining a labyrinth seal therebetween with said extensible member being adapted to contract and expand in response to rotation of said threaded actuator member in opposite directions.

2. A self-sealing coke oven door as defined in claim 1 in which said extensible member is a bellows-like member.

3. In a self-sealing coke oven door carrying a flexible sealing member at the side thereof facing an opening for a coke oven door and including a continuous sealing edge in position to engage an adjacent sealing surface on a coke oven door jamb in response to placement of the door within its coke oven door opening, the improvement comprising:

(a) there being a plurality of spaced apart plunger receiving openings extending through and disposed around the coke oven door adjacent the outer edge thereof, (b) there being a plurality of elongated, outwardly projecting housings carried by the side of said door opposite the side thereof carrying said sealing member with each said housing having a passageway therethrough in alignment with an adjacent plunger receiving opening, (c) an elongated plunger mounted for sliding movement through each said plunger receiving opening with the innermost end of said plunger in position to engage said sealing member and urge said sealing edge into engagement with said sealing surface upon movement of said plunger toward said door jamb, (d) a compression spring mounted within said passageway with the innermost end of said spring contacting the outermost end of said plunger, (e) alignment means within said passageway engaging said spring and retaining said spring out of engagement with the side walls of said passageway, (f) an elongated threaded actuator member carried by the outer end of each said housing for compressing said spring and urging said plunger toward said door jamb and into engagement with said sealing member, (g) a closure member enclosing the outer end of said passageway and having an elongated opening therethrough in alignment with said passageway, and (h) bearing means interposed between said threaded actuator member and an outer portion of the opening in said closure member to define a labyrinth seal therebetween and to maintain said actuator member in axial alignment with said spring.

4. A self-sealing coke oven door as defined in claim 3 in which said threaded actuator member comprises:

(a) an elongated rotatable member mounted for rotation within said bearing means and having external threads on an inner portion thereof, (b) there being a plurality of angularly spaced parallel spline grooves in an inner portion of the opening in said closure member, and (c) an internally threaded sleeve-like member in threaded engagement with said inner portion of said rotatable member with said sleeve-like member having a plurality of angularly spaced parallel splines projecting radially and outwardly into engagement with said spline grooves so that upon rotation of said rotatable member in one direction said sleeve-like member moves toward and into engagement with said spring.

5. In a self-sealing coke oven door carrying a flexible sealing member at the side thereof facing an opening for a coke oven door and including a continuous sealing edge in position to engage an adjacent sealing surface on a coke oven door jamb in response to placement of the door within its coke oven door opening, the improvement comprising:

(a) there being a plurality of spaced apart plunger receiving openings extending through and disposed around the coke oven door adjacent the outer edge thereof, (b) there being a plurality of elongated, outwardly projecting housings carried by the side of said door opposite the side thereof carrying said sealing member with each said housing having a passageway therethrough in alignment with an adjacent plunger receiving opening, (c) an elongated plunger mounted for sliding movement through each said plunger receiving opening with the innermost end of said plunger in position to engage said sealing member and urge said sealing edge into engagement with said sealing surface upon movement of said plunger toward said door jamb, (d) a compression spring mounted within said passageway with the innermost end of said spring contacting the outermost end of said plunger, (e) an elongated threaded actuator member carried by the outer end of each said housing for compressing said spring and urging said plunger toward said door jamb and into engagement with said sealing member, (f) sealing means interposed between said actuator member and an adjacent portion of said housing forming a labyrinth seal which prevents ingress of foreign materials therebetween, (g) a first guide member interposed between the outermost end of said spring and said actuator member with said first guide member having a portion thereof extending inwardly of said outermost end of said spring to limit lateral movement thereof and retain said spring out of engagement with the side walls of said passageway, (h) a second guide member carried by said outermost end of said plunger and having a portion thereof extending outwardly in engagement with said innermost end of said spring to limit lateral movement thereof and retain said spring out of engagement with the side walls of said passageway, (i) there being an opening through said first guide member in alignment with said passageway, (j) there being a longitudinally extending opening through said actuator member in alignment with said opening through said first guide member, and (k) a rod-like member carried by said second guide member and extending through said openings in said first guide member and said actuator member with a sliding fit so that upon rotation of said actuator member in a direction to compress said spring said first guide member moves toward said door jamb.

6. In a self-sealing coke oven door carrying a flexible sealing member at the side thereof facing an opening for a coke oven door and including a continuous sealing edge in position to engage an adjacent sealing surface on a coke oven door jamb in response to placement of the door within its coke oven door opening, the improvement comprising:

(a) there being a plurality of spaced apart plunger receiving openings extending through and disposed around the coke oven door adjacent the outer edge thereof, (b) there being a plurality of elongated, outwardly projecting housings carried by the side of said door opposite the side thereof carrying said sealing member with each said housing having a passageway therethrough in alignment with an adjacent plunger receiving opening, (c) an elongated plunger mounted for sliding movement through each said plunger receiving opening with the innermost end of said plunger in position to engage said sealing member and urge said sealing edge into engagement with said sealing surface upon movement of said plunger toward said door jamb, (d) a compression spring mounted within said passageway with the innermost end of said spring contacting the outermost end of said plunger, (e) an elongated threaded actuator member carried by the outer end of each said housing for compressing said spring and urging said plunger toward said door jamb and into engagement with said sealing member, (f) sealing means interposed between said actuator member and an adjacent portion of said housing forming a labyrinth seal which prevents ingress of foreign materials therebetween, (g) a first guide member interposed between the outermost end of said spring and said actuator member with said first guide member having a portion thereof extending inwardly of said outermost end of said spring to limit lateral movement thereof and retain said spring out of engagement with the side walls of said passageway, (h) a second guide member carried by said outermost end of said plunger and having a portion thereof extending outwardly in engagement with said innermost end of said spring to limit lateral movement thereof and retain said spring out of engagement with the side walls of said passageway, (i) there being a longitudinally extending opening through said actuator member in alignment with said passageway, (j) a rod-like member carried by said first guide member in position to engage said longitudinally extending opening with a sliding fit so that upon rotation of said actuator member in a direction to compress said spring said first guide member is out of engagement with said passageway as it moves toward said door jamb, and (k) an elongated tubular member extending between and slidably engaging said first and second guide members with said tubular member maintaining said guide members in longitudinal alignment with each other as said actuator member compresses said spring.

* * * * *